US005803768A

United States Patent [19]

Zell et al.

[11] Patent Number: 5,803,768

[45] Date of Patent: Sep. 8, 1998

[54] PLUG-TYPE CONNECTOR FOR BACKPLANE WIRINGS

[75] Inventors: Karl Zell, Niederpoecking; Juergen Seibold, Baierbrunn; Peter Seidel, Groebenzell, all of Germany

[73] Assignee: Siemens Aktiengesellschaft, Munich, Germany

[21] Appl. No.: 420,211

[22] Filed: Apr. 11, 1995

[30] Foreign Application Priority Data

Apr. 14, 1994 [DE] Germany ..... 44 12 949.1

[51] Int. Cl.[6] ..... H01R 13/648

[52] U.S. Cl. ..... 439/608; 439/108

[58] Field of Search ..... 439/607, 608, 439/609, 108, 95

[56] References Cited

U.S. PATENT DOCUMENTS

| | | | |
|---|---|---|---|
| 3,182,278 | 5/1965 | Bridle | 439/589 |
| 3,587,028 | 6/1971 | Uberbacher | 439/608 |
| 4,628,652 | 12/1986 | Wefels | 52/306 |
| 4,846,727 | 7/1989 | Glover et al. | 439/108 |
| 4,898,546 | 2/1990 | Elco et al. | 439/608 |

FOREIGN PATENT DOCUMENTS 0 103 192 6/1986 European Pat. Off. .

*Primary Examiner*—Hien Vu
*Attorney, Agent, or Firm*—Hill, Steadman & Simpson

[57] ABSTRACT

The invention is directed to a plug-type connector for backplane wirings, composed of a blade connector portion and a metal spring clip portion. Individual contact springs are surrounded by electrically conductive shielding plates that are connected to contactings applied in an intermediate grid both at the backplane side as well as at the printed circuit board assembly side, the contactings being charged with an appropriate potential.

In order to obtain a comparatively simple structure of the spring clip portion of improved simplicity, the spring clip housing (1–8) is composed of an electrically conductive material, whereby the contact springs (35–37) are arranged insulated therefrom in receptacle chambers (9–16).

17 Claims, 6 Drawing Sheets

FIG 7
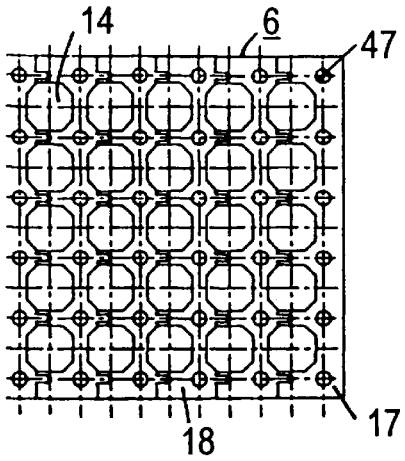
FIG 8
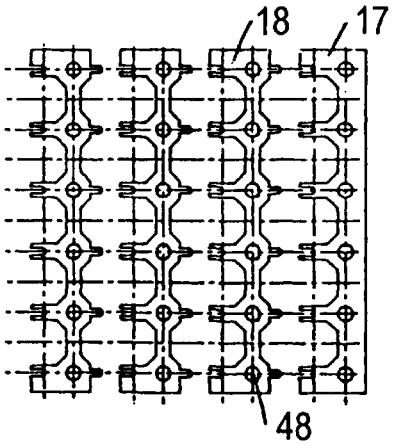
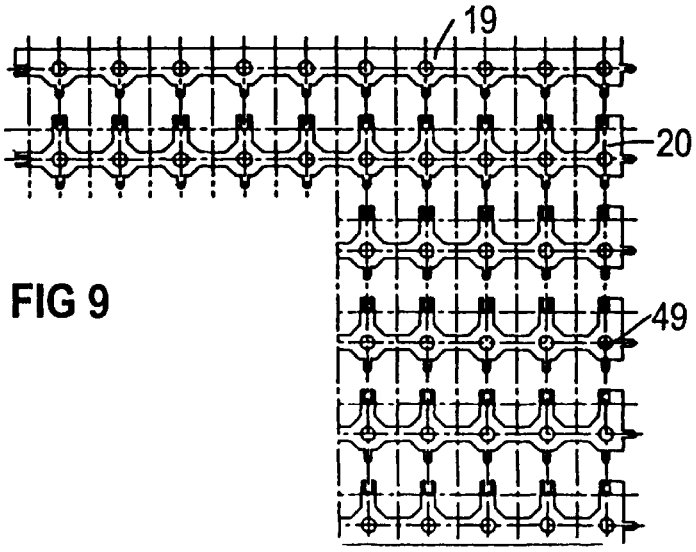
FIG 9

PLUG-TYPE CONNECTOR FOR BACKPLANE WIRINGS

BACKGROUND OF THE INVENTION

The present invention is generally directed to a plug-type connector for backplane wirings. More particularly, the present invention relates to a blade connector portion fashioned as a rectangular housing open at one side for plugging onto the blades of a wiring backplane and of a metal spring clip portion pluggable into the blade connector portion, the spring clip portion being provided with receptacle chambers and firmly joined to an assembly printed circuit board.

As a result of ever-increasing data transmission rates at higher and higher frequencies through an interface formed by a plug-type connector, it is necessary to make plug bodies (currently manufactured of plastic) electromagnetically compatible. Desirably, the plug passage should be smaller and less expensive than a traditional mini-coax.

Up to now, the necessary electromagnetic compatibility was achieved, on the one hand, with the assistance of normal contact pins around an active conductor and, on the other hand, by encapsulation of the individual contact passages with shield elements connected to form a potential cage or electromagnetic shield. Such a conventional plug-type connector is disclosed in European patent application 94103192.4 which includes a complicated structure from a manufacturing standpoint.

SUMMARY OF THE INVENTION

An object of the present invention is to provide a plug-type connector having improved high-frequency properties which meet the increased demands. Another object of the present invention is to provide such a connector having a comparatively simple structure.

These objects are achieved by providing a connector having a spring clip housing portion made composed of an electrically conductive material. The contact springs are arranged insulated therefrom in the receptacle chambers.

The plug-type connector of the invention provides plug passages that are significantly smaller and less expensive than traditional mini-coax plug-type connectors. The connector of the present invention also meets all current demands with respect to the transmission properties. A common housing arrangement lying at grounded potential or, respectively, shield potential does not provide an optimal shielding effect, or even as good as a pure coax plug-type connector, but is still far better than the previous pin arrangement.

An embodiment of the plug-type connector of the present invention provides a spring clip portion with housing having a sheet metal compartment that is plugged together and soldered together and within which continuous receptacle chambers having a rectangular cross section are formed. Such a spring clip housing is comparatively simple to manufacture and offers good shielding properties.

In an embodiment, the blades and springs are arranged parallel in a plurality of rows, whereby the individual contact springs are surrounded by electrically conductive shielding plates that are connected to shield contacts applied in an intermediate shielding grid both at the backplane side as well as at the assembly side, the shield contacts being charged with an appropriate potential.

In an embodiment of the plug-type connector of the invention, the spring clip housing is formed of a one-piece, electrically conductive extruded profile having through receptacle chambers. Spring clip housings manufactured in such a way can, for example, be composed of electrically conductive plastic, providing substantial manufacturing advantages.

Additional features and advantages of the present invention are described in, and will be apparent from, the detailed description of the presently preferred embodiments and from the drawings.

BRIEF DESCRIPTION OF THE DRAWINGS

FIGS. 7–11 are partial cross sections through spring clip housings that are composed of individual extruded profile elements, as well as cross sections through the individual extruded profile elements.

Figure 1:
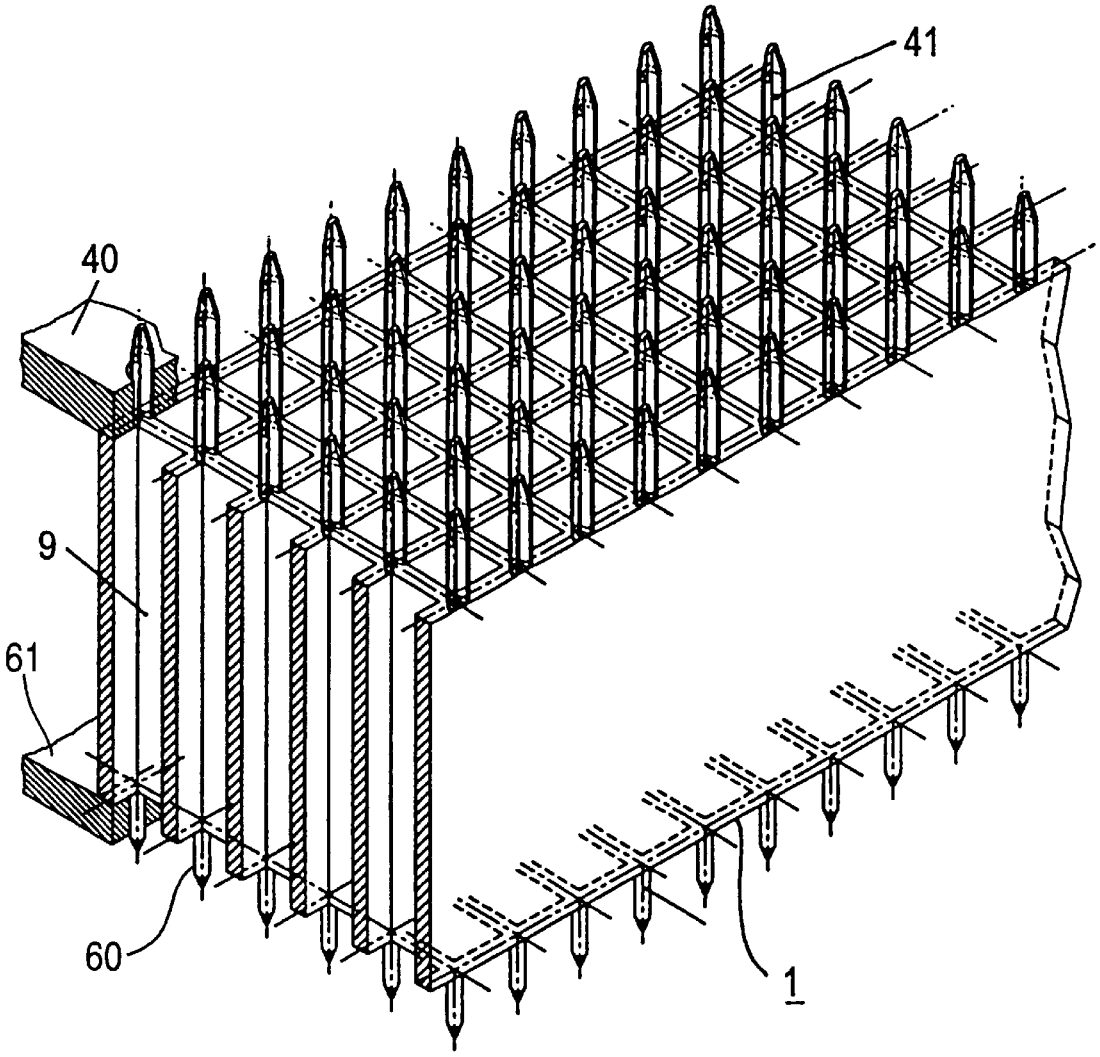
FIG. 1 is a perspective plan view onto a spring clip housing composed of a sheet metal compartments.

Only those component parts necessary for an understanding of the invention are shown in the drawing, i.e. basically the fundamental structure of the spring clip housing.

DETAILED DESCRIPTION OF THE PRESENTLY PREFERRED EMBODIMENTS

FIG. 1 shows a spring clip housing 1 which is essentially a sheet metal compartment formed by metal sheets fitted and soldered together. The spring clip housing 1 defines a plurality of continuous receptacle chambers 9 having a rectangular cross section. The sheet metal compartment is essentially a plurality of slotted longitudinal and transverse sheets that are plugged into one another and are subsequently soldered. Shield contacts 41, for example, are pressed into existing bores can be provided at the crossing points of the sheet metal components. These shield contacts 41, on the other hand, are secured in a printed circuit board 40.

Figure 2:
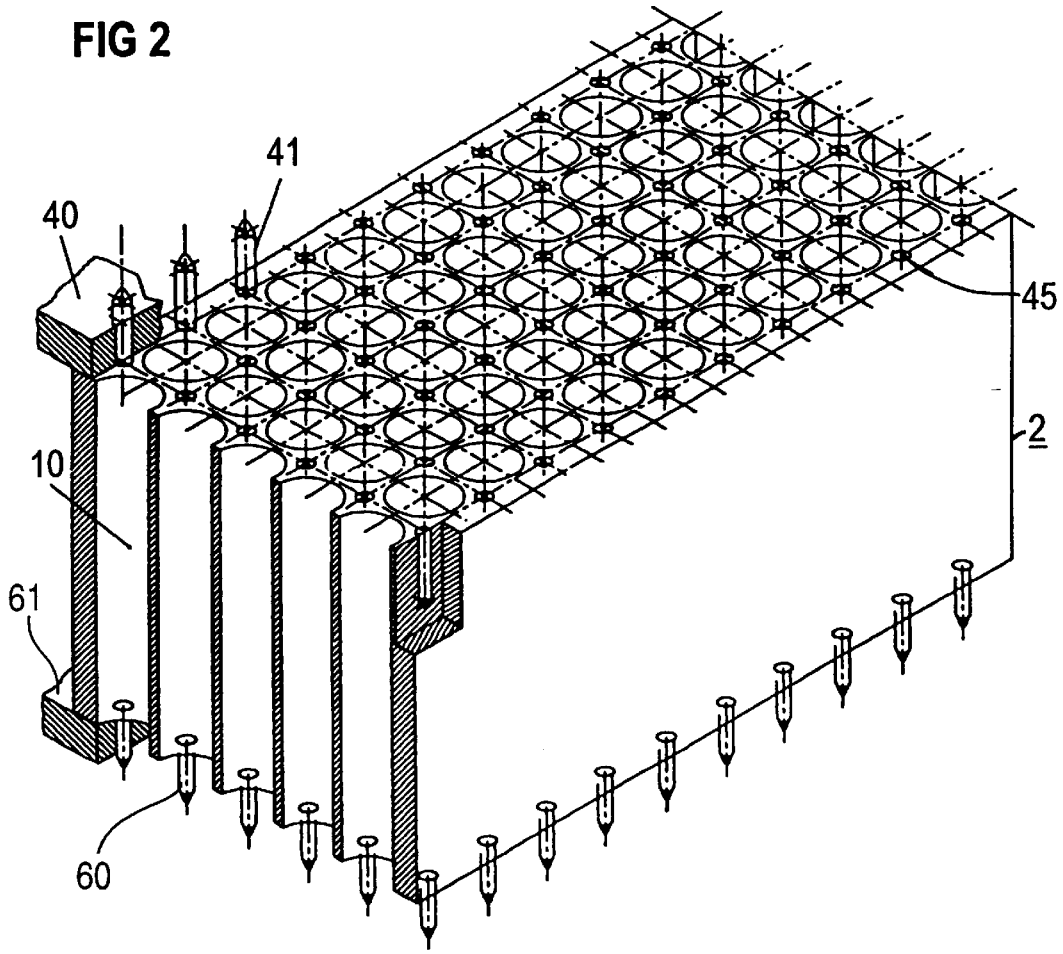
FIG. 2 is a perspective view of a spring clip housing composed of a metal block.
Figure 3:
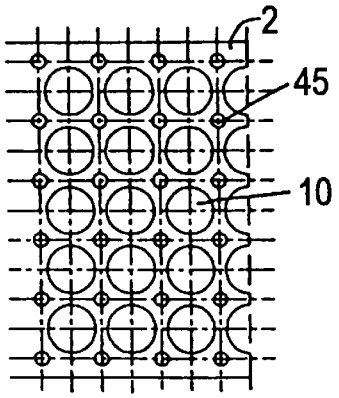
FIG. 3 is a partial cross section through the spring clip housing of FIG. 2.

FIGS. 2 and 3 show a spring clip housing 2 that is composed of a drilled and machined metal block. In the embodiment illustrated, receptacle chambers 10 for the contact springs are formed by drilled bores. Bores 45 for the shielding contactings 41 are provided in an intermediate shielding grid. These bores 45 are fashioned as blind holes into which the shield contacts 41 are secured in a press-in manner. At the opposite side of the spring clip housing, shield contacts 60 can also be provided in the wiring backplane 61.

Figure 4:
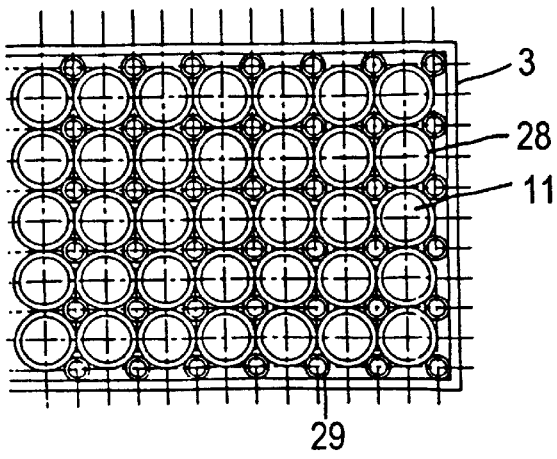
FIGS. 4 and 5 are cross sections through spring clip housings composed of different metallic tubes in a honeycomb-shape.
Figure 5:
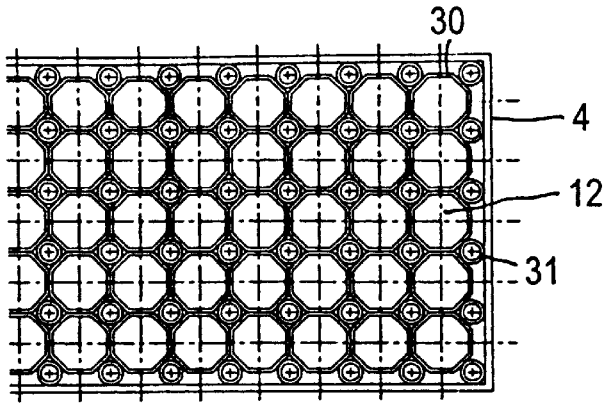

FIGS. 4 and 5 show cross sections through spring clip housings 3 and 4 that are essentially honeycomb-shaped and include parallel large and small metallic tubes 28 and 29 or, respectively, 30 and 31. Given these spring clip housings 3 and 4, the tubes 28 and 29 as well as 30 and 31 are soldered to one another. The tubes having the larger diameter, namely the tubes 28 and 30, form the receptacle chambers 11 and 12, whereas the metallic tubes having the smaller diameters 29 and 31 serve the purpose of accepting the contactings arranged in the intermediate shielding grid. The receptacle chambers of the spring clip housing shown in FIG. 4 have a circular cross section, whereas the receptacle chambers of the spring clip shown in FIG. 5 comprise, for example, an octagonal cross section. The spring clips having a honeycomb-shaped tubular structure shown in FIGS. 4 and 5 can be provided with a smooth outer cladding.

Another fundamental way of manufacturing the spring clip housing of the invention is by forming it from one or more electrically conductive components which can be extruded. In an embodiment, the spring clip is a single extruded profile. In another embodiment, the spring clip is a plurality of corresponding, individual extruded profile elements, whereby the individual extruded profile elements are connected to one another by a tongue and groove arrangement.

Figure 6:
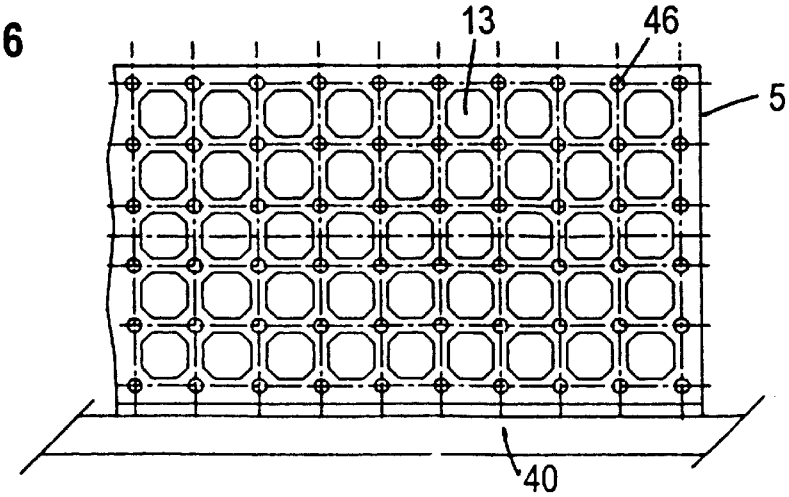
FIG. 6 is a cross section through a spring clip housing composed of a one-piece extruded profile.
Figure 10:
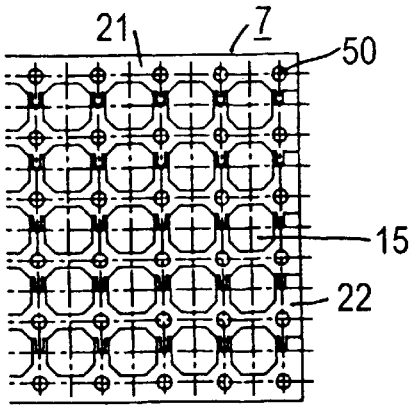
Figure 11:
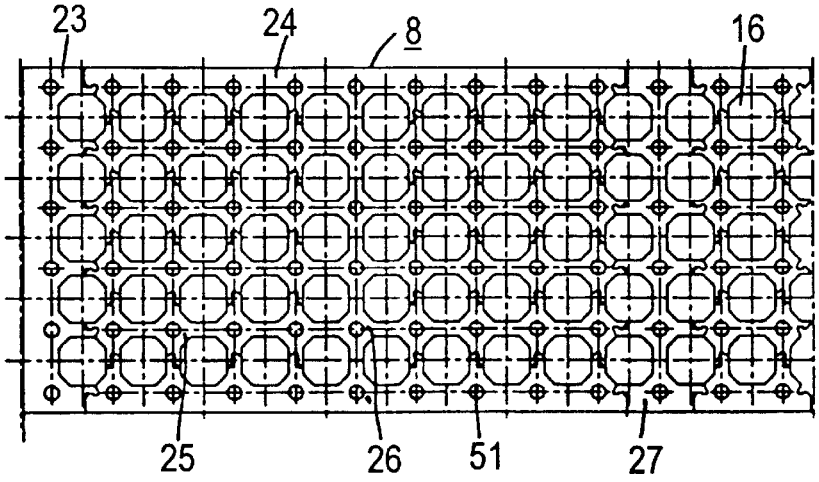

FIG. 6 shows a partial cross section through a spring clip housing 5 of a one-piece, electrically conductive extruded profile adjacent to a printed circuit board 40. The spring clip housing 5 comprises receptacle chambers 13 extending therethrough each having an octagonal cross section. Bores 46 for the necessary shielding contacting are provided in the intermediate grid between the receptacle chambers 13. The spring clip housing 5 shown in FIG. 6, which is fashioned of a one-piece, electrically conductive extruded profile, can be either metal or electrically conductive plastic or, for example, plastic having a voltaically-applied electrically conductive surface coating.

FIGS. 7–11 show individual extruded profile elements 17–27 that can be combined to form complete spring clip housings 6–8, whereby receptacle chambers 14–16 are formed that have the same shape as the receptacle chambers 13 in the spring clip housing 5 of FIG. 6. The individual extruded profile elements 17–27 are joined to one another by tongue and groove. It may already be seen from these few illustrations that the fashioning of the individual extruded profile elements can be extremely multi-faceted, this already deriving from the illustration of a few examples, for which reason these shall not be set forth in greater detail here. Here, too, the individual discrete elements comprise bores 47–51 in the intermediate grid for the shielding contacting.

Figure 12:
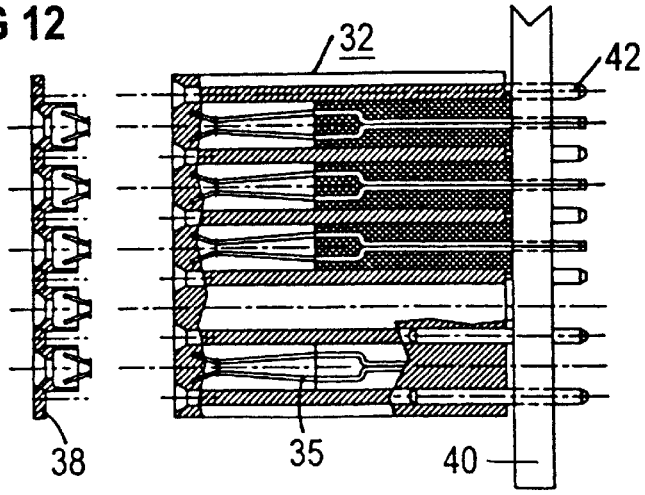
FIGS. 12–14 are cross sections through spring clip housings equipped with contact springs.
Figure 13:
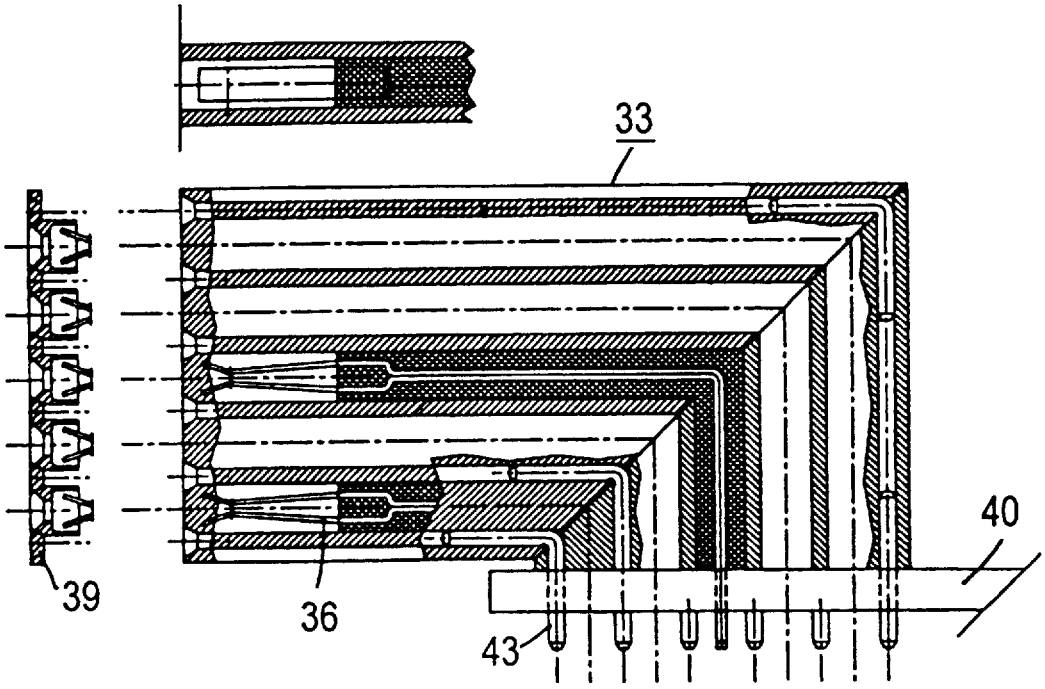
Figure 14:
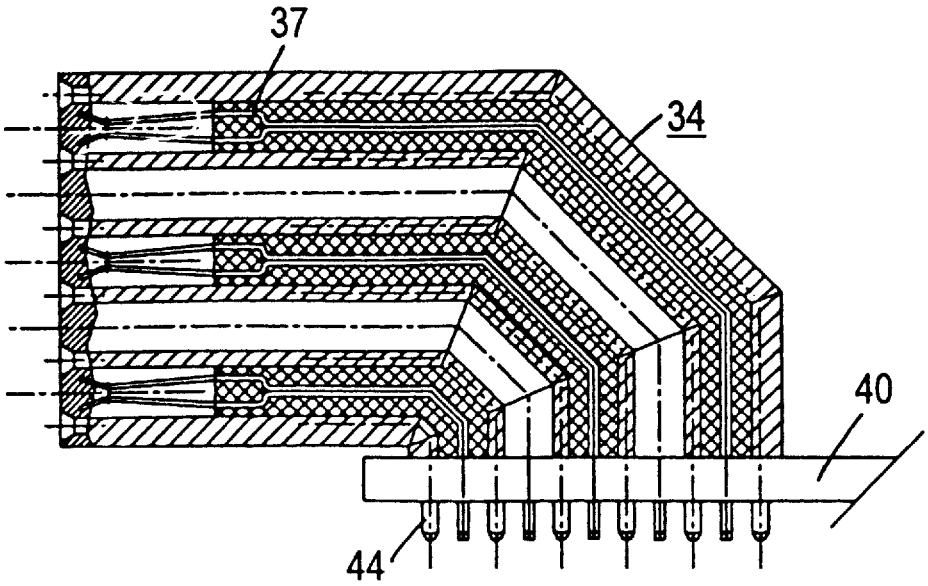

For a better understanding of the invention, FIGS. 12–14 show spring clip housings 33–34 as ultimately equipped with contact springs 35–37. The spring clip housing shown here is intended to represent one type of spring clip structure. The spring clip housing 32 illustrated is a generally straight spring clip housing having straight receptacle chambers. The spring clip housings 33 and 34 are generally angled or L-shaped, being composed of two or more parts.

It may be seen in these FIGS. 12–14 that an attachment member having entry funnels 38 and 39 for the blades that have spring leg detentes of plastic are pressed onto the respective housing at the receptacle side of the spring clip housing. These parts, on the one hand, effect a better guidance of the blades and, at the same time, they prevent the contact springs clad with plastic from being pushed through from the back when the receptacle chambers are equipped, with the contact springs and further when the connector is assembled both to the wiring backplane and the circuit board. At the same time, they prevent a short of the front part of the contact spring to the conductive spring clip housing. The spring clip housings 32, 33 and 34 that are shown are firmly joined to the respective the printed circuit board 40 via shield contacts 42, 43 and 44.

It shall be understood that various changes and modifications to the presently preferred embodiments will be apparent to those skilled in the art. Such changes and modifications can be made without departing from the spirit and scope of the present invention and without diminishing its attendant advantages. Therefore, such changes and modifications are intended to be covered by the appended claims.

What is claimed is:

1. A shielded plug-type connector connectable between a wiring backplane and a printed circuit board, the connector comprising:

a conductive spring clip housing;

a plurality of parallel receptacle chambers defined through the spring clip housing and arranged in at least one row;

a plurality of conductive contact springs, each contact spring having a backplane end insertable onto a contact blade extending from the wiring backplane and an opposite circuit board end being engageably connectable to the printed circuit board, each contact spring being disposed in one of the receptacle chambers so that the contact springs are insulated from the receptacle chambers;

a plurality of shield contacts charged with a shield potential, the shield contacts adapted to contact the backplane and the printed circuit board and to contact opposite ends of the spring clip housing proximal to each receptacle chamber forming an electromagnetic shield around each said contact spring; and wherein the spring clip housing has a plurality of first metal tubes arranged parallel to each other, each first tube defining one of the receptacle chambers, and a plurality of second metal tubes disposed parallel to and in between the first metal tubes defining a honey-comb like arrangement, the second metal tubes each having a smaller diameter than the first metal tubes, each end of the second metal tube receiving one of the shield contacts, wherein the tubes are soldered to one another.

2. The connector according to claim 1 further comprising a plastic coating generally around a part of each contact spring to insulate the contact spring from the corresponding receptacle chamber wall and to seat the contact spring generally centrally within the respective receptacle chamber.

3. The connector according to claim 1 further comprising a blade entry funnel secured at an end of each receptacle chamber for guiding the corresponding blade, each funnel also forming a spring leg detent limiting deflection of the corresponding contact spring.

4. The connector according to claim 1 wherein the shield contacts are secured to the spring clip housing in a press-in manner.

5. The connector according to claim 1 wherein the receptacle chambers are straight.

6. The connector according to claim 1 wherein the receptacle chambers are generally L-shaped.

7. The connector according to claim 1 wherein the plurality of first metal tubes each comprise a circular cylinder.

8. The connector according to claim 1 wherein the first metal tubes each comprise an octagonal cylinder.

9. A shielded plug-type connector connectable between a wiring backplane and a printed circuit board, the connector comprising:

a conductive spring clip housing having a plurality of first tubes arranged parallel to each other, each first tube defining a receptacle chamber, and a plurality of second tubes disposed parallel to and between the first tubes, the second tubes each having a smaller diameter than the first tubes;

a plurality of conductive contact springs, each contact spring having a backplane end insertable onto a contact blade extending from the wiring backplane and an opposite circuit board end being engageably connectable to the printed circuit board, each contact spring being disposed in one of the receptacle chambers so that the contact springs are insulated from the receptacle chambers;

a plurality of shield contacts charged with a shield potential, the shield contacts adapted to contact the backplane and the printed circuit board and being received in said second tubes to contact opposite ends of the spring clip housing forming an electromagnetic shield around each said contact spring; and an attachment member having a plurality of blade entry funnels secured at an end of each receptacle chamber for guiding the corresponding blade, each of the funnels also forming a spring leg detent for preventing the corresponding contact spring from being pushed through the receptacle chamber.

10. The connector according to claim 9 wherein the spring clip housing is formed of a metal block, each receptacle chamber being formed by a drilled-through bore.

11. The connector according to claim 9 wherein the spring clip housing is made of metal.

12. The connector according to claim 9, wherein the spring clip housing is formed of a plurality of sheet metal components inserted over each other in a perpendicular manner, the first tubes defined therebetween so that each receptacle chamber is rectangular in cross section, the second tubes formed as bores in the sheet metal components.

13. The connector according to claim 9 wherein the spring clip housing is formed of a plurality of cooperatively shaped discrete extruded profile elements connected by respectively engaging tongues and grooves.

14. The connector according to claim 9 further comprising a plastic coating generally around a part of each contact spring to insulate the contact spring from the corresponding receptacle chamber and to seat the contact spring generally centrally within the respective receptacle chamber.

15. The connector according to claim 9 wherein the shield contacts are secured to the spring clip housing in a press-in manner.

16. The connector according to claim 9 wherein the receptacle chambers are straight.

17. The connector according to claim 9 wherein the receptacle chambers are generally L-shaped.

* * * * *